US006335668B1

(12) United States Patent
Henningsson et al.

(10) Patent No.: US 6,335,668 B1
(45) Date of Patent: Jan. 1, 2002

(54) CAVITY FILTER

(75) Inventors: Bo Uno Egon Henningsson, Haninge; Matti Liikamaa, Bromma, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/466,227

(22) Filed: Dec. 17, 1999

(30) Foreign Application Priority Data

Dec. 18, 1998 (SE) ..... 9804427

(51) Int. Cl.[7] ..... H01P 1/20
(52) U.S. Cl. ..... 333/202; 333/203; 333/206
(58) Field of Search ..... 333/202, 206, 333/203, 134

(56) References Cited

U.S. PATENT DOCUMENTS 3,693,115 A * 9/1972 Edson ..... 333/73 R
4,024,481 A * 5/1977 Kivi ..... 333/82 BT
4,097,826 A * 6/1978 Knox et al. ..... 333/73 R
4,100,504 A * 7/1978 McGann ..... 333/73 C
5,329,687 A * 7/1994 Scott et al. ..... 333/202

FOREIGN PATENT DOCUMENTS

| | | |
|---|---|---|
| EP | 0823746 | 2/1998 |
| GB | 2067848 | 7/1981 |

* cited by examiner

*Primary Examiner*—Robert Pascal
*Assistant Examiner*—Patricia T. Nguyen
(74) *Attorney, Agent, or Firm*—Burns, Doane, Swecker & Mathis, L.L.P.

(57) ABSTRACT

The present invention relates to a cavity filter (20) that includes a plurality of centre conductors which are mounted on an elevation (22) that extends along several cavities. The elevation can be produced on the bottom surface (23) of the cavity body (21) to a high degree of flatness in one single working step, and a precise measurement and precise parallelity between said bottom surface and the side walls (25) of the cavities can be obtained.

22 Claims, 5 Drawing Sheets

CAVITY FILTER

FIELD OF INVENTION

The present invention relates to an improved cavity filter that can be readily manufactured and worked to a high degree of precision. More particularly, the invention relates to a particular design of the cavity bottom of such a filter.

BACKGROUND OF THE INVENTION

When constructing and manufacturing high-frequency filters for radio base stations, the filters are built-up to form so-called cavity filters that consist of a plurality of cavities, either with a separate centre conductor in each cavity or with more than one centre conductor per cavity. These filters are used, for instance, in base stations for GSM-based mobile telephony at the frequencies of 900 MHz and 1800/1900 MHz.

Each cavity and its centre conductor/conductors functions as an electric oscillating circuit that can be represented by a parallel oscillation circuit having an inductive part L and a capacitive part C when the filter is turned to a quarter wavelength of the received signal. The inductive part is determined essentially by the length of the centre conductor, while the capacitive part is determined essentially by the diameter of the centre conductor and its distance from the cavity side walls and a triming plate provided on the cavity. The filter cavities are disposed in juxtaposed relationship, so that the electromagnetic field generated by the oscillations in one cavity will induce an electric current in an adjacent cavity and therewith also generate oscillations therein. Adaptation of the filter properties is most often achieved through the medium of openings in the walls between two adjacent cavities, so as to enable the coupling factor to be trimmed. The width of the openings between adjacent cavities or the height of the walls therebetween may be variable so as to enable a correct coupling factor to be obtained. However, a cavity filter may also be constructed without walls between mutually sequential centre conductors. In such a filter construction, trimming of the coupling factor between centre conductors can be effected by changing the distance therebetween.

It will be evident from the aforegoing that one important aspect of the function of the cavity filter is that the centre conductor is disposed on a very flat cavity bottom. Since the depth of the cavity influences the function of the cavity, it is essential that the filter body can be manufactured to precise measurements with respect to the distance between the cavity bottom and the upper edge of respective walls, so as to achieve good parallelity between said bottom and said upper edges.

An example of an earlier known cavity bottom construction is shown in FIG. 1, which also shows a known centre conductor. The Figure illustrates in cross-section a centre conductor 13 mounted in a cavity that comprises a cavity-defining body 11 and a cavity bottom 12. In this known construction, the bottom 12 is formed in the same working step as the manufacture of the cavity in general. This method of manufacture, however, means that the cavity bottom will not obtain the surface finish, planarity or flatness, that is required in order of the centre conductor to fulfil its function in the best way.

According to this known solution, the centre conductor 13 is hollow so that it can be secured to the cavity bottom 12 by means of a screw 14 passed through openings in the bottom surface of the centre conductor and the bottom of said cavity. The electric junction between the centre conductor and the cavity bottom is comprised of the bottom surface that lies around the screw, which bottom surface may be deficient with respect to surface finish and flatness in the case of this known construction.

It is thus desirable to obtain a cavity filter that has the aforedescribed advantageous properties and that can be manufactured readily despite the high precision requirements involved.

SUMMARY OF THE INVENTION

The present invention relates to an improved cavity filter construction.

A first object of the invention is to provide a cavity filter that can be readily manufactured despite high precision requirements.

Another object of the present invention is to provide a cavity filter where only certain parts of the cavity and the upper edge of the side walls need be precision worked so as to obtain a very flat surface on which the centre conductors are secured while achieving, at the same time, precise measurements and parallelity between the bottom surface and the upper edge of said cavity.

These objects are achieved with an inventive cavity filter that includes a plurality of centre conductors which are disposed on a flat groove or a flat elevation that is preferably elevated slightly above the bottom of the cavity or on a cylindrical portion that forms an integral part of the cavity filter. The cavity filter need not include any intermediate walls.

A first advantage afforded by the inventive cavity filter is that it enables manufacture to be simplified. Instead of accurately working, e.g. machining or treating, the whole of the cavity bottom in order to obtain a flat bottom surface, it is only necessary to machine the aforesaid groove or elevation or the upper surface of said cylindrical portion in order to obtain the requisite degree of flatness. This working can be effected in one single manufacturing stage, by excluding the walls between the cavities. The obtained flat surface provides a reference surface in the continued working of the cavity body, so as to obtain an exact measurement and good parallelity between the centre conductor contact surface and the upper edge of the cavity body.

Another advantage afforded by the inventive cavity filter is that trimming of the coupling factor between mutually adjacent centre conductors is simplified. The walls between two centre conductors are not required for trimming purposes, and all that is necessary is to change their distance from the machined groove or elevation.

The invention will now be described in more detail with reference to preferred exemplifying embodiments thereof and also with reference to the accompanying drawings.

DESCRIPTION OF PREFERRED EMBODIMENTS

Figure 1:
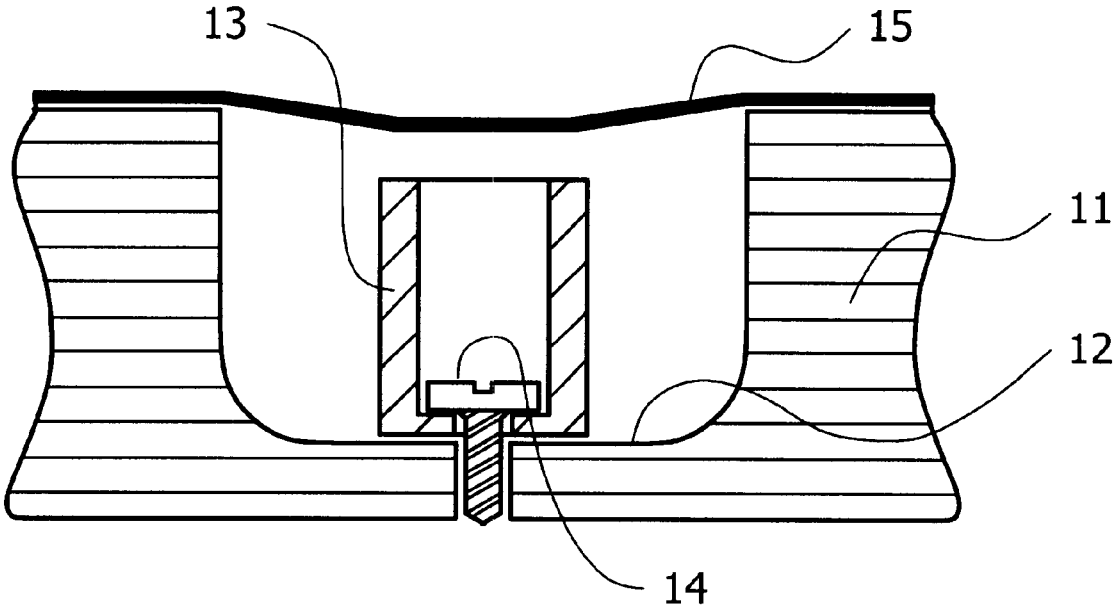
FIG. 1 illustrates an earlier known arrangement of a centre conductor in a cavity filter.
Figure 2A:
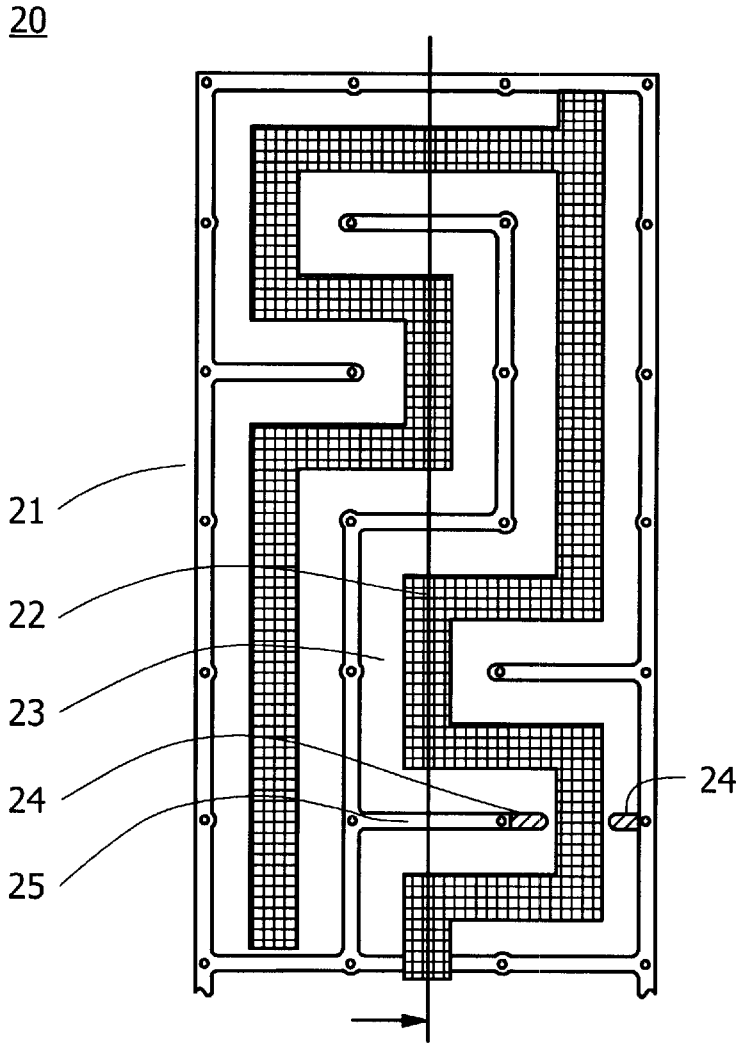
FIG. 2 is a cross-sectional view and a view taken from above of a first embodiment of an inventive cavity filter.
Figure 2B:
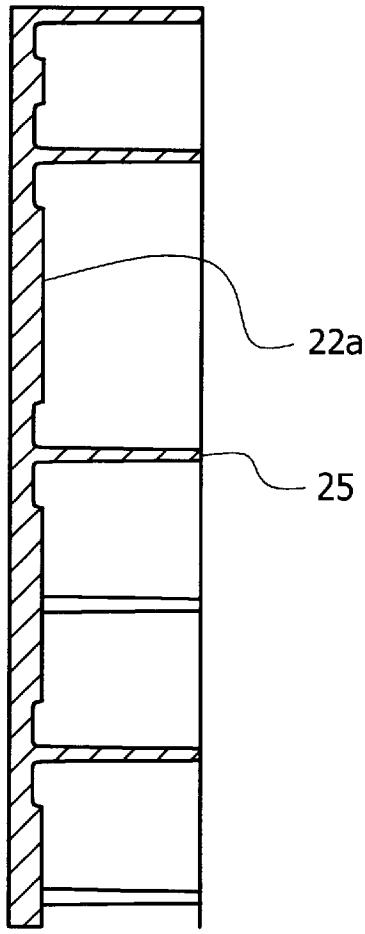

FIG. 2 is a cross-sectional view and a view taken from above of a first embodiment of an inventive cavity filter. The filter 20 includes a body 21 and a cavity bottom 23 in which there is provided an elevation 22 for securing a centre conductor. In the illustrated embodiment, the elevation is raised about 1–2 mm above the bottom 23 of the cavity and extends through said cavity or through several cavities that are delimited by side walls 21, 25.

Figure 5:
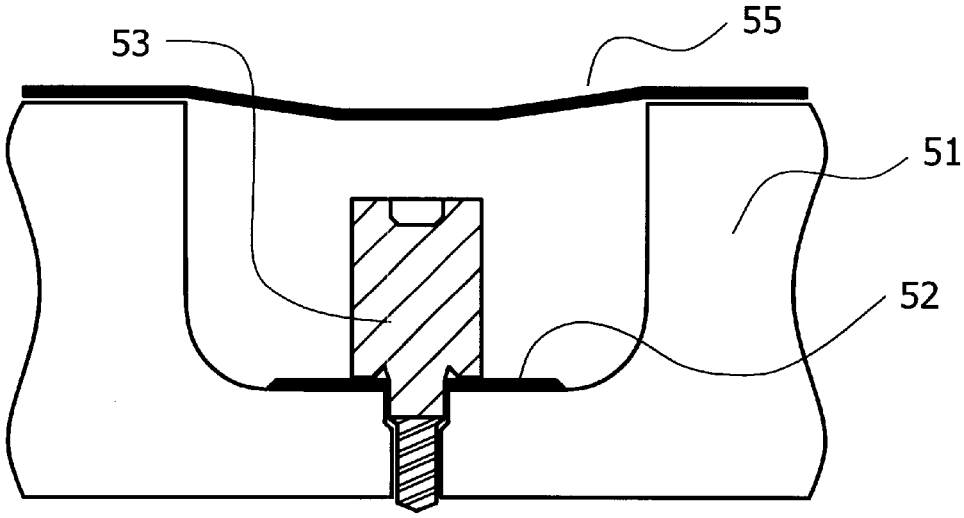
FIG. 5 illustrates a centre conductor in an inventive cavity filter according to the first embodiment of the present invention fastened to the bottom of the cavity.

FIG. 5 is a cross-sectional view showing a part of an inventive cavity filter according to the first embodiment of the present invention and a centre conductor 53. The cavity filter includes a body 51 and a cavity that is covered by a trimming plate 55. In the embodiment shown in FIG. 5, the centre conductor 53 is fastened to an elevation 52 raised above the cavity bottom, this elevation corresponding to the elevation 22 in FIG. 2. The elevation 52 has been worked to a very flat surface and is slightly wider than the diameter of the centre conductor. It will be seen from the figure that an inventive cavity filter which enables a flat surface to be readily created can be used advantageously in arranging the centre conductors when good contact is required between the centre conductor and the cavity bottom.

One advantage afforded by the inventive cavity filter is that no particular precision requirements need be made when manufacturing the moulded or cast body 21. In the preferred embodiment shown in FIG. 2, that part intended for the elevation 22 is raised slightly above the surface of the cavity bottom 23. This preliminarily formed surface need not fulfil high flatness requirements at this stage. On the other hand, the raised surface must be higher than the level of the desired flat surface, since the flatness of this desired surface is preferably achieved by a milling process or by some flat-polishing process. Manufacture can thus be effected both rationally and inexpensively and with only a small amount of waste.

In the case of the inventive cavity filter it is only necessary to machine two parts of the filter to a high degree of precision in order to achieve the requirement of a flat surface for attachment of the centre conductor on the one hand and to obtain precise measurements between the cavity bottom and the upper edge of the cavity walls on the other hand, these two parts corresponding the elevation 22 and the side wall 25 and body 21. The flat elevation 22 is obtained by milling the pre-formed raised surface on the cavity bottom 23, or by some other general flat-polishing process. Because the cavity filter according to this preferred embodiment of the invention lacks intermediate walls between the various centre conductors, the cavity bottom can be worked in one single working stage instead of working each individual cavity. The resultant flat bottom surface can be used as a reference surface for working the upper side of the cavity walls. It shall be possible to adjust the distance between the elevation on the bottom of the cavity and the upper edge of the cavity side walls to a very precise measurement. The upper edge and the elevation shall extend parallel with one another so that the same distance can be retained therebetween along the full extent of the cavity filter.

A cavity filter according to the first embodiment has an elevation 22, 52 which is elevated slightly above the bottom of the cavity and which is worked to obtain a high degree of flatness. When working a raised elevation no burrs will occur, meaning that the edges of the elevation need not be subsequently worked. The height of the elevation, however, can be varied to provide a suitable working measurement. In one conceivable modification of the inventive cavity filter, the flat surface may be provided directly on the bottom of the cavity in the absence of a raised surface, or may even be milled as a groove to a level slightly beneath the level of the bottom of the cavity. On the other hand, it is essential that is groove is at least equally as wide as the diameter of the bottom surface of the centre conductors disposed thereon, so that said conductors will rest on the bottom of the groove with the whole of the bottom surface and particularly with the outer edge. This is a decisive feature, since the electric current in the centre conductors is conducted essentially nearest the surface. In the case of the preferred embodiment, however, the width of the elevation or groove is at least twice as large as the diameter of the bottom surface of the centre conductors.

Figure 3:
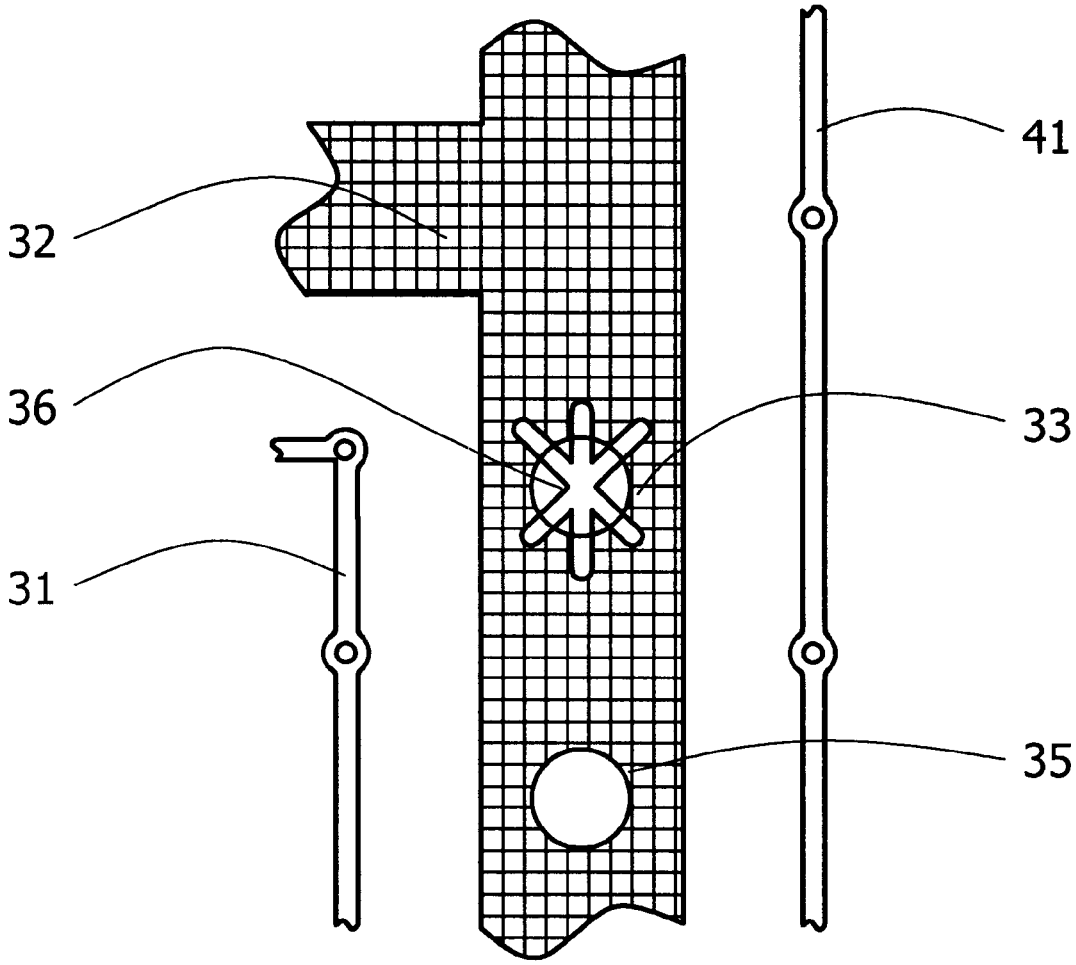
FIG. 3 illustrates a part of an inventive cavity filter having means for securing and adjusting a centre conductor.

A filter according to the preferred embodiment does not require the presence of intermediate walls between the various centre conductors, and the elevation or groove can thus extend along one or more cavities. As before mentioned, this enables an elevation or groove to be formed more easily on the bottom of the cavity. Mechanical working of the filter is simplified because walls between the cavities need not be worked mechanically in order to trim the coupling factor of the centre conductors. Trimming is normally effected by changing the opening between two mutually adjacent cavities. The field strength of the electromagnetic fields between two centre conductors can be changed through the medium of these openings to obtain different coupling factors. In the case of the inventive cavity filter, trimming is conveniently effected by altering the distance between the juxtaposed centre conductors on the elevation or groove. FIG. 3 shows part of an inventive cavity filter according to the first embodiment of the present invention that includes side walls 31 and an elevation 32 which extends through one or more cavities. The position of a centre conductor 33 mounted on the elevation 32 can be adjusted in relation to an adjacent centre conductor 35, by moving the centre conductor 33 along a contemplated elevation 36 until the correct distance between the centre conductors 33 and 35 has been reached. The centre conductor 33 can be moved either solely in the longitudinal direction of the elevation or in a composite direction of movement, i.e. simultaneously in the longitudinal direction of the elevation and orthogonally thereto. The centre conductor 33 is only then secured in the elevation 32.

Because the aforesaid requirements relating to flatness, precise measurements and parallelity between the elevation or groove and the upper surface of the cavity walls are fulfilled along the whole of the elevation or groove, the centre conductors can be arranged readily in the desired positions in the elevation or groove for trimming purposes. However, this does not exclude a cavity filter that includes an elevation or a groove such as that described above in which trimming is effected by changing the height or the opening width of intermediate walls 24 between mutually adjacent cavities, provided that the openings are wider than the elevation or groove so that said elevation or groove can be produced in one single working step. Intermediate walls 24 may, however, also be required to enhance the stability of the body in the casting or moulding process when manufacture takes place under very high pressures.

Figure 4A:
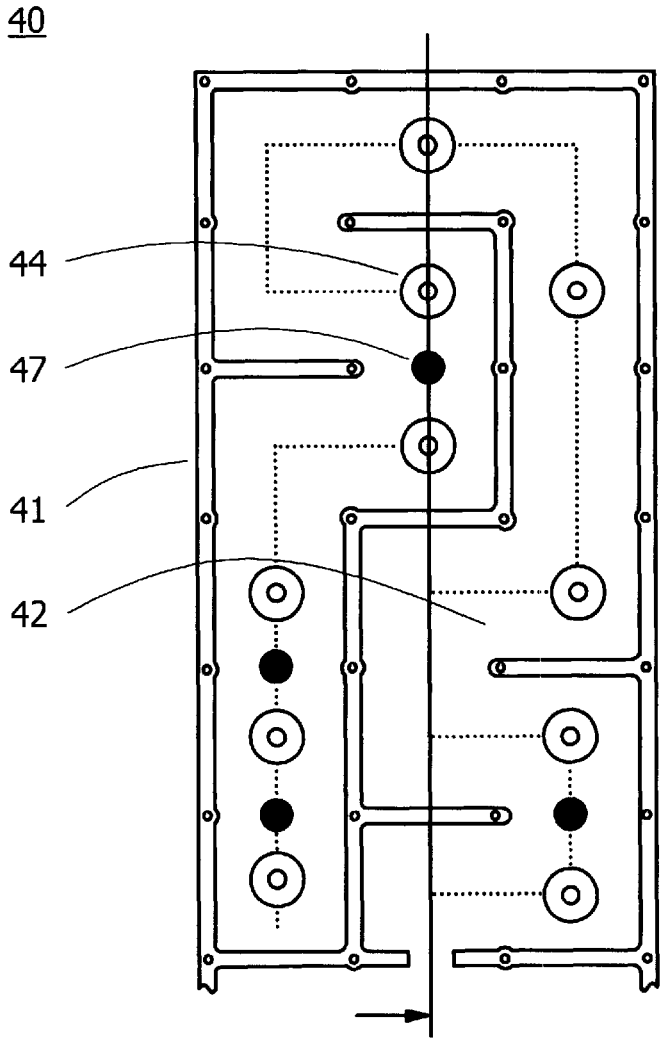
FIG. 4 is a cross-sectional view and a view taken from above of a second preferred embodiment of an inventive cavity filter.
Figure 4B:
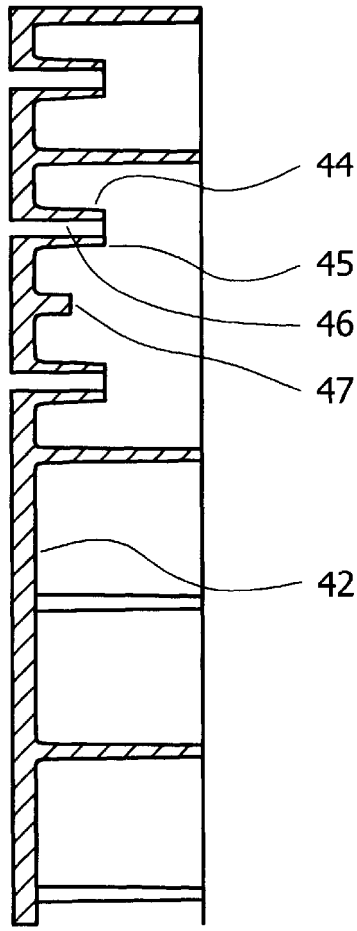

FIG. 4 is a cross-sectional view and a view taken from above of a second preferred embodiment of the present invention. The filter 40 includes a body 41 and a cavity bottom 42 in which there are provided cylindrical portions 44 that form an integral part of the cavity filter. According to this embodiment, from the pre-formed upper surfaces 45 of said cylindrical portions 44 a flat surface is obtained by milling said pre-formed surfaces 45, or by some other general flat-polishing process. At least some of said cylindrical portions 44 are designed with a hollowness 46 through their entire length along with the centre axis and through the cavity bottom. Said hollowness is intended for mounting a centre conductor. Thus, it is only necessary to machine said upper surface 45 of the filter to a high degree of precision in order to achieve the requirement of a flat surface for attachment of the centre conductor on the one hand and to obtain precise measurements between the cavity bottom and the upper edge of the cavity walls on the other hand. Trimming is done by means of pegs 47 that are arranged between said cylindrical portions. The trimming can be influenced by the position of said pegs 47 and their height.

Figure 6:
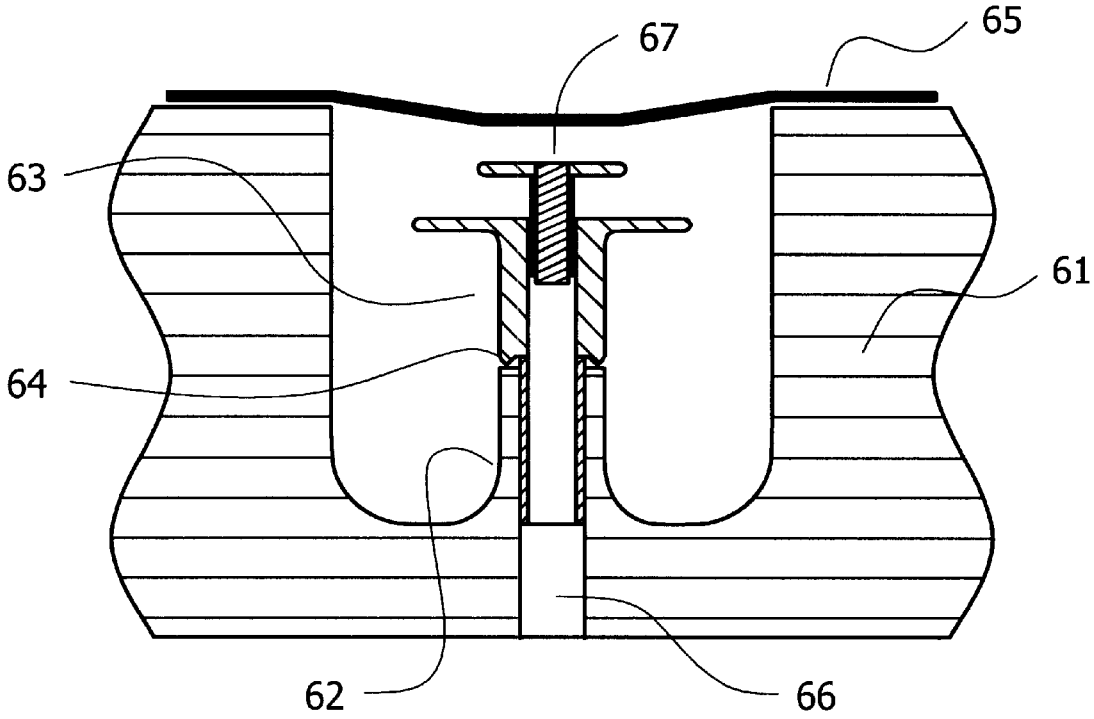
FIG. 6 illustrates a centre conductor in an inventive cavity filter according to the second embodiment of the present invention fastened to a cylindrical portion that is an integral part of the cavity.

FIG. 6 is a cross-sectional view showing a part of an inventive cavity filter according to the second embodiment of the present invention and a centre conductor 63. The cavity filter includes a body 61 and a cavity that is covered by a trimming plate 65. In this embodiment, the centre conductor 63 is fastened to a cylindrical portion 62 that is an integral part of the cavity filter. Said cylindrical portion 62 has been worked to a very flat surface 64. The hollowness 66 along with the centre axis of the cylindrical portion 62 is preferably equipped with threads such that the centre conductor 63, possibly equipped with an additional trimming element 67 can be screwed in.

The inventive cavity filter is preferably produced by a casting or moulding process in which a body 21 is obtained as a one-piece structure. The material from which the filter 20 is comprised must fulfil certain criteria. An advantageous material shall be readily workable so that the elevation or groove in the cavity bottom 23 and the measurement of the side walls 25 and possible intermediate walls 24 can be provided in a simple manner. The material must also be light in weight, so as not to increase the weight of the filter more than necessary and shall have good current conducting capacity. These requirements are fulfilled essentially by aluminium and magnesium, for instance.

It will be understood that the invention is not restricted to the aforedescribed and illustrated exemplifying embodiments thereof and that modifications can be made within the scope of the following claims.

What is claimed is:

1. A cavity filter comprising a body and a plurality of centre conductors, characterised by an elevation (22,52,44, 62) provided on the bottom of the cavity for securing centre conductors among other things, wherein the width of said elevation (22,52,44,62) is at least equal to the diameter of the bottom surface of the centre conductors, characterised in said elevation being designed as cylindrical portions (44,62) forming an integral part of the cavity bottom (42) and placed with certain distances between each other, characterised in pegs (47) intended for trimming of the coupling factor and mounted between at least some of said cylindrical portions (44).

2. A cavity filter comprising a body an a plurality of centre conductors, characterised by an elevation (22,52,44,62) provided on the bottom of the cavity for securing centre conductors among other things, wherein the width of said elevation (22,52,44,62) is at least equal to the diameter of the bottom surface of the centre conductors, characterised in that the width of the elevation (22,32,44,52) is at least twice the diameter of the bottom surface of the centre conductors.

3. A cavity filter according to claim 2, characterised in said elevation being designed as cylindrical portions (44,62) forming an integral part of the cavity bottom (42) and placed with certain distances between each other.

4. A cavity filter according to claim 2, characterised in that the filter lacks intermediate walls between mutually adjacent centre conductors, either completely or in part.

5. A cavity filter according to claim 2, wherein the cavity body is comprised of aluminium.

6. A cavity filter comprising a body and a plurality of centre conductors, characterised by an elevation (22,52,44, 62) provided on the bottom of the cavity for securing centre conductors among other things, wherein the width of said elevation (22,52,44,62) is at least equal to the diameter of the bottom surface of the centre conductors, characterised in that the cavity body is comprised of magnesium.

7. A method for the manufacture of a cavity filter, characterised by casting or moulding a cavity body as a one-piece structure and surface-grinding a flat-bottom groove along the cavity bottom and mounting a plurality of centre conductors on said flat groove.

8. A method according to claim 7, characterised by manufacturing the cavity body without providing intermediate walls between mutually adjacent cavities, either completely or in part.

9. A method according to claim 7, characterised by producing the cavity body with a raised surface on the cavity bottom and forming said groove in said raised surface.

10. A cavity filter comprising a body and a plurality of centre conductors, characterised by a groove provided on the bottom of the cavity for securing center conductors among other things, wherein the width of said groove is at least twice the diameter of the bottom surface of the centre conductors.

11. A cavity filter according to claim 10, wherein the cavity body is comprised of aluminium.

12. A cavity filter according to claim 10, wherein solely the upper surface of the groove on the cavity bottom exhibits good flatness; and in that the upper surface (25) of the cavity walls has a given fixed distance from the upper surface of said groove along the full length of the filter.

13. A cavity filter according to claim 10, wherein the cavity body consist of magnesium.

14. A cavity filter according to claim 2, wherein said elevation is designed as cylindrical portions (44,62) forming an integral part of the cavity bottom (42) and placed with certain distances between each other and wherein pegs (47), which are intended for trimming of the coupling factor, are mounted between at least some of said cylindrical portions (44).

15. A cavity filter according to claim 2, wherein solely the upper surface **(22*a*,64) of the elevation on the cavity bottom exhibits good flatness and the upper surface (25) of the cavity walls has a given fixed distance from the upper surface (22*a*, 64)** of said elevation along the full length of the filter.

16. A cavity filter according to claim 2, wherein the filter lacks intermediate walls between mutually adjacent centre conductors, either completely or in part.

17. A method for the manufacture of a cavity filter, comprising casting or moulding a cavity body as a one-piece structure with at least one raised surface on the cavity bottom and surface-grinding a flat-bottom elevation on said raised surface and mounting a plurality of centre conductors on said raised surface.

18. A cavity filter according to claim 10, wherein the filter lacks intermediate walls between mutually adjacent centre conductors, either completely or in part.

19. A method according to claim 17, characterised by manufacturing the cavity body without providing intermediate walls between mutually adjacent cavities, wither completely or in part.

20. A cavity filter comprising a body and a plurality of centre conductors, said filter comprising an elevation provided on the bottom of the cavity for securing said centre conductors, wherein the width of said elevation is at least twice the diameter of the bottom surface of said centre conductors.

21. A cavity filter according to claim 20, wherein said elevation is designed as cylindrical portions forming an integral part of said cavity bottom and placed with certain distances between each other and wherein pegs, which are intended for trimming of the coupling factor, are mounted between at least some of said cylindrical portions.

22. A cavity filter according to claim 20, wherein solely the upper surface of said elevation on the cavity bottom exhibits good flatness and the upper surface of the cavity walls has a given fixed distance from the upper surface of said elevation along the full length of said filter.

* * * * *